US005105178A

United States Patent [19]

Krumme

[11] Patent Number: 5,105,178

[45] Date of Patent: Apr. 14, 1992

[54] OVER-CURRENT/OVER-TEMPERATURE PROTECTION DEVICE

[76] Inventor: John F. Krumme, 87 Upenuf Rd., Woodside, Calif. 94062

[21] Appl. No.: 687,792

[22] Filed: Apr. 19, 1991

[51] Int. Cl.[5] ..... H01H 61/06; H01H 71/18

[52] U.S. Cl. ..... 337/140; 337/395; 361/103

[58] Field of Search ..... 337/140, 395, 394, 393; 439/161; 361/103

[56] References Cited

U.S. PATENT DOCUMENTS

| | | | |
|---|---|---|---|
| 3,544,943 | 12/1970 | Hoagland, Jr. . | |
| 3,684,994 | 8/1972 | Tyler . | |
| 3,707,694 | 12/1972 | DuRocher . | |
| 3,725,835 | 4/1973 | Hopkins et al. . | |
| 3,810,059 | 5/1974 | Jost | 337/140 |
| 3,906,422 | 9/1975 | Healy . | |
| 4,205,293 | 5/1980 | Melton et al. . | |
| 4,263,573 | 4/1981 | Melton et al. . | |
| 4,371,791 | 2/1983 | Mercier . | |
| 4,462,651 | 7/1984 | McGaffigan . | |
| 4,621,882 | 11/1986 | Krumme . | |
| 4,643,500 | 2/1987 | Krumme . | |
| 4,734,047 | 3/1988 | Krumme . | |
| 4,797,649 | 1/1989 | Homma | 337/140 |
| 4,846,729 | 7/1989 | Hikami et al. . | |
| 4,881,908 | 11/1989 | Perry et al. | 439/161 |

FOREIGN PATENT DOCUMENTS

WO90/10965 9/1990 PCT Int'l Appl. .

*Primary Examiner*—Harold Broome
*Attorney, Agent, or Firm*—Burns, Doane, Swecker & Mathis

[57] ABSTRACT

An over-current/over-temperature protection device which includes first and second electrical contacts, a separable resistance electrical separable path extending between the contacts, a breaker means and a heater. The heater comprises the separable path. The breaker breaks an electrical connection between at least one of the contacts and the separable path when current above a threshold value passes through the separable path and/or the over-current/over-temperature protection device reaches a threshold temperature. The breaker includes a member of a shape memory alloy which changes shape from a first configuration to a second configuration when the member is heated from a first temperature $T_1$ to a second temperature $T_2$. The heater heats the member from the first temperature $T_1$ to the second temperature $T_2$ so that the member changes from the first configuration to the second configuration. The over-current/over-temperature protection device can include a spring for changing the member into the first configuration when the member cools from the second temperature $T_2$ to a temperature $T_3$ below $T_2$. The over-current/over-temperature protection device can include a permanent resistance electrical current path having a resistance higher than the separable path. The permanent path minimizes arcing when the electrical connection between the separable path and at least one of the contacts is broken by the breaker.

36 Claims, 2 Drawing Sheets

OVER-CURRENT/OVER-TEMPERATURE PROTECTION DEVICE

BACKGROUND OF THE INVENTION

1. Field of the Invention

This invention relates to circuit protection devices that limit or shut off current flow in conditions of over-current and/or over-temperature.

2. Description Of Related Technology

Raychem Corporation, Menlo Park, California markets a circuit protection device called a "polyswitch." Raychem's "polyswitch" includes a polymeric material loaded with conductive material such as carbon particles which is normally conductive. If the current load increases beyond a predetermined value, the polymer heats up and expands with the result that the conductive particles are separated enough to prevent flow of current through the polymer. A problem with this polymeric type device is that it has an undesirably slow response time due to low thermal conductivity of the polymeric materials. Accordingly, there is a need in the art for a device which quickly changes from a low resistance to a high resistance when an over-current or an over-temperature condition exists.

Another problem with the polymeric device is internal "arcing" which occurs when the current flow is interrupted between adjacent particles. This internal "arcing" leads to breakdown of the polymer and hence limits the upper voltage which can be applied to the device. Accordingly, there is a need in the art for a more reliable switch capable of performing under higher voltage and current conditions.

Another inherent problem of polymeric devices is that the conductivity is relatively low even in its most conductive state. As a result, high current devices are undesirably large in size when low resistance levels are required.

Ceramic PTC (positive temperature coefficient) devices based on barium titanate perform very similarly to polymeric devices and also display catastrophic breakdown when exposed to elevated voltage and/or current conditions.

Various types of mechanical switching arrangements are known in the art. For instance, U.S. Pat. No. 3,544,943 ("Hoagland") discloses an over-current responsive device which includes a pair of terminals electrically connected together by a thermally responsive element. The thermally responsive element includes two elongated cantilevered members supported at one end to a pair of posts. The posts are electrically connected to the terminals. The first elongated member is electrically insulated from the posts. One end of the second elongated member is welded to a free end of the first member. The second member is also bifurcated into two arms, one arm being electrically connected to one post and the other arm being electrically connected to the other post. Current flows from one terminal, along one arm, then along the other arm to the other terminal. The size, shape, and/or materials of the first and second members are chosen such that the second member is heated and the two members swing in one direction to activate a snap-action switch under overload conditions.

Shape memory alloys have been used in electrical connectors. For instance, U.S. Pat. No. 4,621,882 ("Krumme") discloses an electrical connector wherein a first strip which terminates in a split tube is removably connected to a second strip. The split tube includes a shape memory alloy layer which opens or closes the tube. For instance, the tube can include a metal layer which acts as a spring to close the tube when the shape memory layer is in its ductile and soft martensitic state and the shape memory layer changes shape and overpowers the force of the metal layer when the shape memory layer is heated to its austenitic state. The tube can include a flexible heater for heating the shape memory layer.

U.S. Pat. No. 4,643,500 ("Krumme") discloses a multi-contact zero insertion force electrical connector. In a first embodiment, the connector includes a pair of flexible spaced-apart sidewalls, slides having camming surfaces extend along inner surfaces of the sidewalls, pairs of spaced-apart contacts are provided between the sidewalls, upper ends of the contacts are attached to the respective sidewalls by extensions on the sidewalls, and the slides are pushed and pulled by means of a shape memory U-shaped Nitinol (nickel-titanium) wire which extends around the sidewalls with free ends of the wire connected to terminals. To insert a printed circuit board between the sidewalls, current is applied across the terminals to heat the wire to its austenitic state which causes the wire to shrink to a memory state. As a result, the upper portions of the sidewalls are pushed apart by the slides. Upon cooling of the wire, the sidewalls move towards each other and the contacts clamp the circuit board in place.

In another embodiment, Krumme discloses opposed pairs of contacts supported in a body, a U-shaped bail is slidably supported between the contacts, an S-shaped Nitinol member is between the body and the bail, and a pair of leads are connected to the Nitinol member for heating thereof or heating a heater bonded thereto. When the Nitinol member is heated to its austenitic state it expands and pushes up on the bail which in turn pushes the contacts apart. The Nitinol member can be covered with insulation to prevent electrical contact with the contacts.

U.S. Pat. No. 4,734,047 ("Krumme") discloses a multi-contact zero insertion force electrical connector. In a heat-to-open embodiment, a plurality o fork-shaped contacts include distal ends for holding a substrate. A split tube of a shape memory alloy is provided between the distal ends for spreading the distal ends when the alloy is heated to its austenitic state. A spring is concentrically layered with respect to the tube for deforming the tube when the alloy is in its martensitic state. The alloy is heated by a heater located within the tube. Alternatively, in a cool-to-open embodiment, the spring can be provided within the tube and the contacts are opened by cooling the alloy to its martensitic state whereby the spring expands the tube to spread the distal ends. The spring can be eliminated in the heat-to-open embodiment since the contacts are resilient and will deform the tube when the alloy is in its martensitic state. In addition, the tube can be resistance heated by passing a current therethrough.

U.S. Pat. No. 4,881,908 ("Perry") discloses a connector having a spring in the form of an elongated split tube and a heat-recoverable member of shape memory alloy positioned within the tube. Opposed sets of contact pads are positioned between the ends of the spring and are movable into and out of contact with a substrate inserted between the contact pads. To open the connector, the shape memory alloy is heated by passing a current therethrough or by using a resistance heater circuit or a separate resistance heater. For instance, a heater can be provided between the spring and the shape memory alloy. When the shape memory alloy is in a deformable state below a transition temperature, the spring deforms the shape memory alloy to close the connector. When the shape memory alloy is in a memory state above the transition temperature, the shape memory alloy recovers to its non-deformed state.

SUMMARY OF THE INVENTION

The invention provides an over-current and/or over-temperature protection device which includes first and second electrical contacts, a separable electric current path extending between the contacts, breaker means and heater means. The heater means comprises the separable path which can be a high or low resistance path. The breaker means breaks an electrical connection between at least one of the contacts and the separable path when current above a threshold value passes through the separable path. The breaker means includes a member of a shape memory alloy which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

According to one aspect of the invention, the over-current/over-temperature protection device can be self-resetting. In this case, the over-current/over-temperature protection device includes means for changing the member into the first configuration when the member cools from the second temperature $T_2$ to a third temperature $T_3$ deemed safe for operation of the circuit being protected. The third temperature $T_3$ is below $T_2$ and preferably is at least about 15° C. below $T_2$.

According to another aspect of the invention, the over-current/over-temperature protection device can include means for minimizing arcing when the electrical connection between the separable path and at least one of the contacts is broken by the breaker means. The arc minimizing means comprises a permanent electrical current path extending between the contacts. The permanent path can have a high resistance to flow of electrical current therethrough. The resistance of the permanent path can be any value but typically is at least two times that of the separable path. Any ratio of resistance is attainable between the separable and permanent paths.

The separable and permanent paths can each comprise a flex circuit which includes an electrically conductive layer such as a sputtered metallic or non-metallic conductive film or screen printed conductive ink on a polymer film. The separable and permanent paths can each include a layer of dielectric material on the conductive layer. The dielectric material prevents flow of electrical current from the separable and/or permanent paths to the member while allowing the member to be heated to the second temperature $T_2$ by heat produced by the conductive layer when current flows through the separable and/or permanent paths.

In one embodiment, the contacts have free ends located in an interior space within a housing. The free ends of the contacts are movable from a first position in electrical contact with the separable path to a second position out of electrical contact with the separable path. The contacts are in the first position when the member is in the first configuration and the contacts are in the second position when the member is in the second configuration. The member can be U-shaped with one free end thereof facing the first contact and another free end thereof facing the second contact. The ends of the U-shaped member can be closer together in the first configuration than in the second configuration. The contacts can be spring loaded such that the contacts return to the first position when the member changes from the second configuration to the first configuration. The housing can include first, second and third support surfaces in the interior space. The first support surface can be arcuate and face a central portion of the polymer film of the separable path. The second and third surfaces can be opposite sides of a wall. The second support surface can be attached to one end of the polymer film and the third support surface can be attached to an opposite end of the polymer film. The U-shaped member can be supported between the polymer films of the separable and permanent paths.

In another embodiment, the contacts include contact zones which are immovable with respect to each other. The separable path has free ends which are movable from a first position in electrical contact with the contact zones to a second position out of electrical contact with the contact zones. The free ends of the separable path are in the first position when the member is in the first configuration and the free ends of the separable path are in the second position when the member is in the second configuration.

The member can be U-shaped and the contact zones can be located between free ends of the U-shaped member. The free ends of the U-shaped member can be closer together in the first configuration than in the second configuration. A spring can be provided for biasing the free ends of the separable path in the first position. The spring can comprise a bent strip having an arcuate central portion and inwardly curved end sections extending from the central portion. Each free end of the separable path can be attached to a respective end section of the spring. The spring biases the free ends of the separable path towards the contacts so that the separable path is in electrical contact with the contact zones when the U-shaped member is in its first configuration. The U-shaped member bends the end sections of the spring outwardly away from the contact zones when the U-shaped member is in the second configuration.

The housing can include first, second and third support surfaces within the interior space. The first contact zone can be attached to the first support surface. The second contact zone can be attached to the second support surface. The permanent path can be attached to the third support surface. The first and second support surfaces can comprise opposite sides of a wall extending from a base of the housing and into a center of the interior space. The first contact zone can comprise a conductive layer on the first support surface, the second contact zone can comprise a conductive layer on the second support surface, and the polymer film of the permanent path can be adhesively bonded to the third support surface. The third support surface can be convex in cross section and face a concave portion of the U-shaped member. The housing can include a pair of leads on an exterior surface thereof and the leads can be electrically connected to the contact zones.

BRIEF DESCRIPTION OF THE DRAWING

The invention is described with reference to the attached drawing, in which.

DETAILED DESCRIPTION OF THE PREFERRED EMBODIMENTS

The invention provides an over-current/over-temperature protection device which interrupts flow of electrical current between two contacts in response to either an over-current and/or over-temperature condition. The over-current/over-temperature protection device can be designed to meet the needs of a wide variety of electrical circuits. In particular, the over-current/over-temperature protection device can be designed to rapidly break an electrical connection in response to a current or temperature overload condition.

The over-current/over-temperature protection device includes first and second electrical contacts, a separable electrical current path extending between the contacts, breaker means and heater means. The heater means comprises the separable path. The breaker means breaks an electrical connection between at least one of the contacts and the separable path when current above a threshold value passes through the separable path. The breaker means includes a member made of shape memory alloy such as NiTi which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

According to one aspect of the invention, the over-current/over-temperature protection device can be self-resetting. In this case, the over-current/over-temperature protection device includes means for changing the member back into the first configuration when the member cools from the second temperature $T_2$ to a third temperature $T_3$ deemed safe for current operations, typically about 15° C. below $T_2$.

According to another aspect of the invention, the over-current/over-temperature protection device can include means for minimizing arcing when the electrical connection between the separable path and at least one of the contacts is broken by the breaker means. The arc minimizing means comprises a permanent electrical current path extending between the contacts, the permanent path having a high resistance to flow of electrical current therethrough. The resistance of the high resistance path can be any value. For instance, the resistance of the permanent path can be 2 times or more than that of the separable path. Virtually any ratio of resistances between the separable and permanent paths can be used depending on specific circuit needs.

Figure 1:
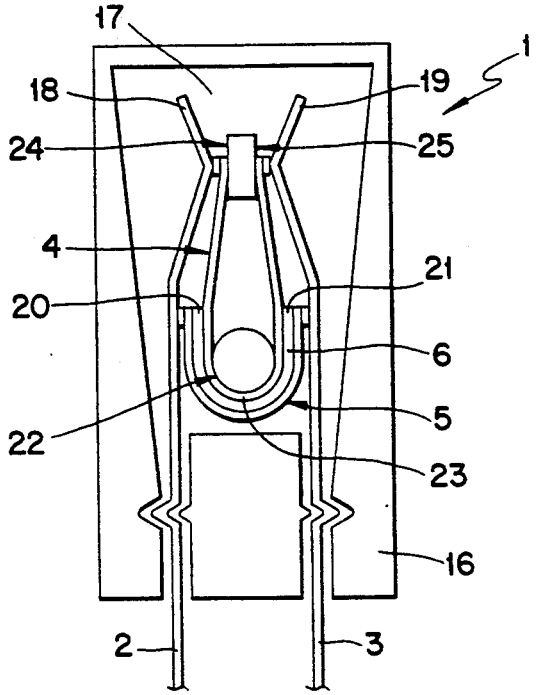
FIG. 1 shows a cross-section of a self-resetting over-current/over-temperature protection device in accordance with one embodiment of the invention.

A first embodiment of the over-current/over-temperature protection device of the invention is shown in FIG. 1. The over-current/over-temperature protection device includes first and second electrical contacts, a separable electrical current path extending between the contacts, breaker means and heater means. The heater means comprises the separable path. The breaker means breaks an electrical connection between the separable path and at least one of the contacts when current above a threshold value passes between the contacts through the separable path. The breaker means includes a member made of a shape memory alloy which changes shape from a first configuration to a second configuration when the member is heated from a first temperature $T_1$ to a second temperature $T_2$. The heater means heats the member from the first temperature $T_1$ to the second temperature $T_2$ so that the member changes from the first configuration to the second configuration.

The over-current/over-temperature protection device can be made self-resetting by providing means to reset the contacts and the member to their original positions. This can be accomplished by making the contacts from a spring material and biasing them together. Alternatively, the over-current/over-temperature protection device can be manually resettable by suitable means.

The over-current/over-temperature protection device can also include means to minimize arcing when the electrical connection between the separable path and the contacts is broken. The arc minimizing means comprises a permanent resistance electrical current path that remains continuous (i.e., unbroken) whether or not the separable path is or is not in electrical contact with both of the contacts. The permanent path can also provide enough heat to the member to maintain it in its second configuration until the over-current and/or over-temperature condition is relieved or removed.

The over-current/over-temperature protection device shown in FIG. 1 includes first and second electrical contacts 2,3. Separable electrical current path 4 extends between contacts 2,3 and permanent electrical current path 5 extends between contacts 2,3. Breaker means 6 breaks an electrical connection between at least one contact 2,3 and separable path 4 when current above a threshold value flows through separable path 4 and/or permanent path 5.

The breaker means comprises member 6 made of a shape memory alloy such as a strip of Ni-Ti which changes shape from a first bent configuration to a second less bent configuration when member 6 is heated from first temperature $T_1$ to second temperature $T_2$. Separable path 4 and/or permanent path 5 perform an additional function of heating member 6 from first temperature $T_1$ to second temperature $T_2$ when current above the threshold value flows through separable path 4 and/or permanent path 5. As a result, member 6 changes shape from the more bent configuration to the less bent configuration and forces contacts 2,3 to spread apart so as to be out of contact with separable path 4.

Permanent path 5 minimizes arcing when the electrical connection between contacts 2,3 and separable path 4 is broken by member 6. That is, permanent path 5 provides an alternative path for flow of electrical current between contacts 2,3. The ratio of the resistance of permanent path 5 to that of separable path 4 can be set at any arbitrary value such as 2:1, 50:1, 100:1, 250:1, 500:1, 1000:1, etc. For instance, the resistance of separable path 4 could be 1 ohm and the resistance of permanent path 5 could be 100 ohms or higher. In addition to minimizing arcing, permanent path 5 continues to provide an adequate heating effect to maintain the device in its "open" or "tripped" condition until the over-current and/or over-temperature condition causing triggering of the device is relieved or removed.

Figure 2:
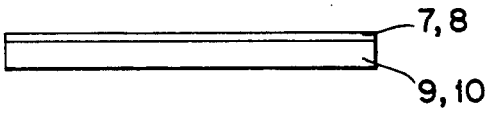
FIG. 2 shows a side view of a resistance electrical current path usable in the over-current/over-temperature protection device of the invention.
Figure 3:
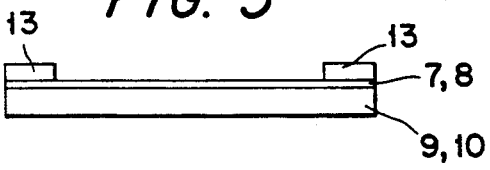
FIG. 3 shows a side view of the resistance path shown in FIG. 2 with contact pads thereon.

To manufacture separable path 4, electrically conductive layer 7 is deposited on polymer film 9, as shown in FIG. 2. Likewise, permanent path 5 can be manufactured by depositing electrically conductive layer 8 on polymer film 10. Conductive layer 8, however, preferably has a higher electrical resistance than layer 7. The higher resistance of layer 8 can be obtained in various ways. For instance, if layers 7,8 comprise the same material and are deposited in the same thickness, permanent path 5 could comprise a more narrow strip of composite 8,10 than composite 7,9. That is, the wider strip comprising separable path 4 can have a greater area over which the current flows and thus, lower resistance to the flow of current therethrough compared to permanent path 5.

As an example, polymer film 10 can comprise a polyimide film which is 0.0005 to 0.001 inch thick and 0.075 inch wide. Conductive layer 8 can comprise a nichrome sputtered deposit on polymer film 10. The thickness of nichrome layer 8 can be adjusted in accordance with the desired resistance of the permanent path 5. For instance, the thickness of nichrome layer 8 can be adjusted to provide a resistance of 1000 ohms. Separable path 4 can comprise a polyimide film 9 which is 0.0005 to 0.001 inch thick and 0.05 inch wide with a nichrome or copper layer 7 thereon in a thickness to provide a desired resistance such as 1 ohm. Accordingly, various materials and dimensions (length, width, thickness) can be utilized in designing separable and permanent paths 4,5.

Figure 4:
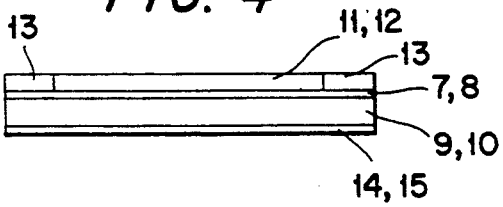
FIG. 4 shows a side view of the resistance path shown in FIG. 3 with a dielectric layer and an adhesive layer thereon.

Separable and permanent paths 4,5 can be used with or without one or more electrically insulating coatings. However, to prevent leakage of current to surrounding electrically conducting materials, paths 4,5 can be provided with a coating of dielectric material. For instance, separable path 4 can include layer 11 of dielectric material on conductive layer 7, as shown in FIG. 4. Likewise, permanent path 5 can include layer 12 of dielectric material on conductive layer 8. The dielectric material can comprise any suitable electrically insulating material such as polymer or ceramic materials.

Figure 5:
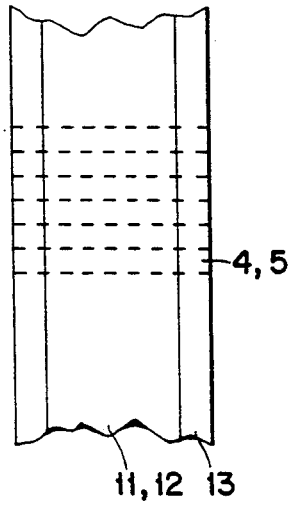
FIG. 5 shows a top view of a ribbon which can be cut to provide a plurality of resistance paths usable in the over-current/over-temperature protection device of the invention.

The dielectric material 11,12 can be applied in any suitable manner such as by techniques conventionally used in semiconductor processing. For example, a sheet of polyimide 9,10 having a metallic layer of nichrome 7,8 can be masked off and dielectric 11,12 can be deposited on the nichrome layer 7,8 in a desirable pattern. The article shown in FIG. 5 comprises a ribbon cut from such a sheet of polyimide 9,10 having nichrome layer 7,8 and dielectric layer 11,12 thereon. Separable paths 4 can comprise strips cut from the ribbon shown in FIG. 5. Likewise, permanent paths 5 can comprise more narrow strips cut from the same or a similar ribbon.

Separable and permanent paths 4,5 can be used with or without contact pads. However, to provide for optimized current flow into and out of paths 4,5, pads 13 of an electrically conducting corrosion resistant material can be provided on conductive layers 7,8. For instance, pads 13 can comprise a layered structure of copper, nickel, gold, etc. Or, for instance, pads 13 could comprise a single layer of copper, with tin-lead solder plating over the copper layer.

To form pads 13, the metal or metals of the pad can be plated on conductive layers 7,8. For instance, if dielectric layer 11,12 is already present, the metal or metals of pads 13 can be plated up directly on conductive layer 7,8.

As shown in FIG. 1, member 6 is surrounded on both sides by paths 4,5. Dielectric layer 11 on separable path 4 faces and/or contacts member 6 and prevents flow of electrical current from separable path 4 to member 6 while allowing member 6 to be heated to second temperature $T_2$ by heat produced by conductive layer 7 when current above a threshold value $I_c$ flows through separable path 4. Dielectric layer 12 can be in contact with member 6 to prevent flow of electrical current from permanent path 5 to member 6. Paths 4,5 can be used with or without adhesive means thereon. However, to provide for attachment to other parts, paths 4,5 can include adhesive layers 14,15. For instance, polymer film 9 can include adhesive layer 14 on one side and conductive layer 7 on the other side thereof, as shown in FIG. 4. Likewise, polymer film 10 can include adhesive layer 15 on one side and conductive layer 8 on the other side thereof. Additional adhesive layers could be provided on dielectric layers 11,12, if desired.

In the embodiment shown in FIG. 1, housing 16 includes interior space 17 within which contacts 2,3, paths 4,5 and member 6 are located. Housing 16 can be extremely small in size with an overall height of about 0.5 inch and a width of less than 0.5 inch, for example. Of course, the principles of the invention can be applied to larger or smaller devices.

Contacts 2,3 have free ends 18,19 thereof within interior space 17. Free ends 18,19 are movable from a first position in electrical contact with separable path 4 (as shown in FIG. 1) to a second position (now shown) out of electrical contact with separable path 4. Free ends 18,19 are in the first position when member 6 is in its first configuration and free ends 18,19 are in the second position when member 6 is in its second configuration.

Member 6 can be U-shaped in the first and second configurations with one free end 20 facing first contact 2 and another free end 21 facing second contact 3. Free ends 20,21 are closer together when member 6 is in its first configuration than when member 6 is in its second configuration. Member 6 can comprise a rectilinearly extending strip which is bent into a U-shape in its easily deformed martensitic condition at first temperature $T_1$. When heated to second temperature $T_2$, member 6 changes into its austenitic state and attempts to revert to its memorized flat condition thereby causing free ends 20, 21 to spread apart and force free ends 18,19 of contacts 2,3 away from each other.

Contacts 2,3 can be of an elastic or springy material such as beryllium-copper (Be-Cu). In the arrangement shown in FIG. 1, contacts 2,3 include U-shaped bends which are received in corresponding U-shaped grooves in housing 16. This arrangement holds contacts 2,3 in a precise relationship to each other and such that they are spring loaded. Spring loaded contacts 2,3 return to the first position when member 6 changes from the second configuration to the first configuration. As explained earlier, member 6 is easily deformed at the first temperature $T_1$ since it is in its martensitic condition. As such, spring loaded contacts 2,3 bend member 6 into its first configuration when member 6 cools from second temperature $T_2$ to a lower temperature $T_3$ such as about 15° C. lower than $T_2$. Alternatively, contacts 2,3 can be spring loaded so as to be biased towards each other by other suitable means such as a spring, springs, elastomeric material, or other mechanical equivalent.

As shown in FIG. 1, housing 16 can include accurate support surface 22 in interior space 17. Central portion 23 of separable path 4 extends around surface 22. Surface 22 can face polymer film 9 of separable path 4. To secure separable path 4 in position, adhesive layer 14 can be used to attach polymer film 9 to surface 22.

Housing 16 can include support surfaces 24,25 to which opposite ends of separable path 4 are attached. In the arrangement shown in FIG. 1, surfaces 24,25 are spaced apart and face in opposite directions. One end of separable path 4 can be attached to surface 24 by means of adhesive layer 14 and the opposite end of separable path 4 can be attached to surface 25 by adhesive layer 14.

Figure 6:
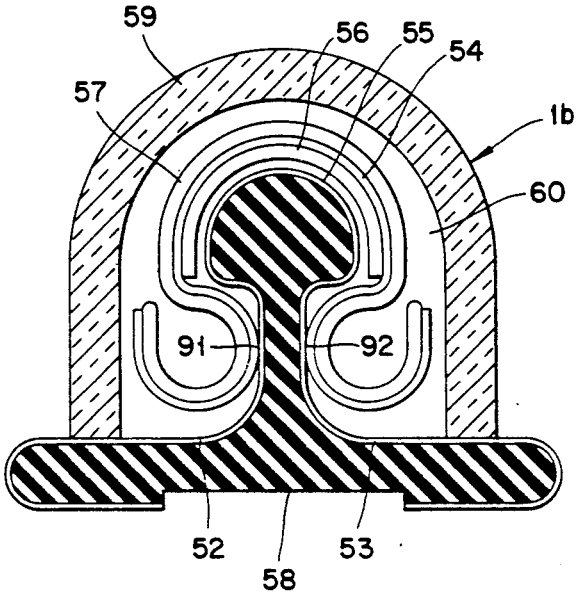
FIG. 6 shows a self-resetting over-current/over-temperature protection device in accordance with a second embodiment of the invention.
Figure 7:
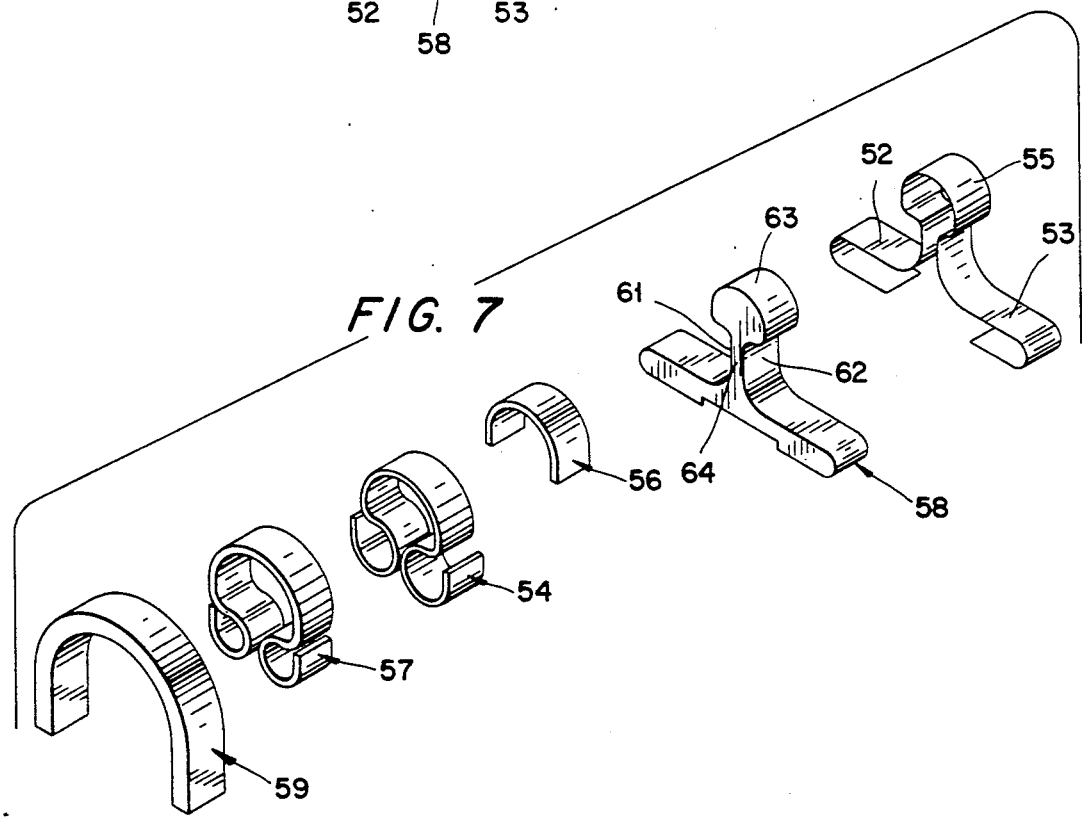
FIG. 7 shows a perspective exploded view of various parts of the arrangement shown in FIG. 6.

A second embodiment of the invention is shown in FIGS. 6–7. In this embodiment, over-current/over-temperature protection device lb includes contacts 52, 53 which have contact zones located in interior space 60 within housing 59. Contacts 52, 53 are immovable with respect to each other and permanent path 55 provides a non-separable high resistance electrical path between contacts 52 and 53. Separable resistance current path 54 has contact zones 91, 92 which are movable from a first position (as shown in FIG. 6) in electrical contact with contact zones of contacts 52,53 to a second position out of electrical contact therewith. Contact zones 91,92 are in the first position when member 56 is in a first configuration (as shown in FIG. 6) and contact zones 91,92 are in the second position when member 56 is in a second configuration. Separable path 54 preferable has a lower resistance than permanent path 55.

Spring 57 is provided for biasing the contact zones 91,92 of separable path 54 in the first position. Spring 57 comprises an elastic strip having an arcuate central portion and ring shaped end sections extending inwardly from the central portion. Contact zones 91,92 of separable path 54 are attached to the respective end sections of spring 57. Spring 57 biases contact zones 91,92 of separable path 54 towards the contact zones of contacts 52,53 so that separable path 54 is in electrical contact with contacts 52, 53 when the U-shaped member 56 is in its first configuration. U-shaped member 56 bends the end sections of spring 57 outwardly away from the contact zones of contacts 52,53 when U-shaped member 56 is heated from a first temperature $T_1$ to a second temperature $T_2$ to change member 56 into the second configuration.

A housing of the over-current/over-temperature protection device includes base 58 and cover 59. Base 58 includes first, second and third support surfaces 61-63 within interior space 60. The contact zone of first contact 52 is attached to first support surface 61. The contact zone of second contact 53 is attached to second support surface 62. Permanent path 55 is attached to third support surface 63. First and second support surfaces 61 62 comprise opposite sides of wall 64 extending from base 58 and into a center of interior space 60 within cover 59. Surface 63 comprises an outer surface of an enlargement extending from one end of wall 64. First contact 52 can comprise a copper plating, second contact 53 can comprise another copper plating and permanent path 55 can comprise a nichrome film on a single strip of polymer film. Alternatively, contacts 52,53 and permanent path 55 can comprise coterminous metal layers on a polymer film. For instance, contacts 52,53 and permanent path 55 can comprise a polymer film with coterminous metallic layers on one side thereof. The metallic layers can include a metallic layer such as nichrome on a central portion of the polymer film and metallic layers such as copper on ends of the polymer film. In this case, the central metallic layer comprises permanent path 55 and the other metallic layers comprise contacts 52,53. The polymer film can include adhesive to attach the film to surfaces 61-63.

In cases where the over-current/over-temperature protection device is not automatically resettable, the over-current/over-temperature protection device can include a manually resettable mechanism. For example, a movable button extending through an upper part of the housing can be provided for pushing the spring and shape memory alloy member back into configurations in which separable path 54 is in contact with the contact zones of contacts 52,53. In this case, the over-current-/over-temperature protection device shown in FIG. 6 can include biasing means such as a pair of springs urging the respective end sections of spring 57 away from base 58 and towards an upper part of cover 59. When member 56 is in its first configuration, however, contact zones 91,91 of separable path 54 tightly grip the contact zones of contacts 52,53 by friction, thus preventing spring 57 from moving upwardly along wall 64 due to the force of the biasing means. When an over-current/over-temperature condition exits, contact zones 91,92 move away from the contact zones of contacts 52,53. As a result, the biasing means push spring 57 upwardly. Cover 59 can include a suitably shaped recess for receiving the reset button such that the button only extends out of cover 59 when spring 57 is moved upwardly due to an over-current/over-temperature condition. Once the over-current/over-temperature condition no longer exits, member 56 will cool and transform to its martensitic condition thereby allowing spring 57 to press against opposite sides of wall 64 when the button is depressed.

While the invention has been described with reference to the foregoing embodiments, various changes and modifications can be made to the invention which fall within the scope of the appended claims.

What is claimed is:

1. A self-resetting over-current/over-temperature protection device comprising:

first and second electrical contacts;

a separable resistance electrical current path extending between the contacts, the separable path having a resistance to flow of electrical current therethrough;

breaker means for breaking an electrical connection between at least one of the contacts and the separable path when current above a threshold value flows through the separable path and/or the over-current/over-temperature protection device reaches a threshold temperature, the means comprising a member of a shape memory alloy which changes shape from a first configuration to a second configuration when the member is heated from a first temperature $T_1$ to a second temperature $T_2$;

for heating the member heater means from the first temperature $T_1$ to the second temperature $T_2$ so that the member changes from the first configuration to the second configuration when current above the threshold value flows through the separable path, the heater means comprising the separable path; and means for changing the member into the first configuration when the member cools from the second temperature $T_2$ to a third temperature $T_3$ below the second temperature $T_2$.

2. The self-resetting over-current/over-temperature protection device of claim 1, further comprising arc minimizing means for minimizing arcing when the electrical connection between the contacts and separable path is broken by the breaker means, the arc minimizing means comprising a permanent resistance electrical current path extending between the contacts, the permanent path having a higher resistance to flow of electrical current therethrough than the separable path.

3. The self-resetting over-current/over-temperature protection device of claim 1, wherein the separable path comprises an electrically conductive layer on a polymer film.

4. The self-resetting over-current/over-temperature protection device of claim 2, wherein the separable path comprises a first electrically conductive layer on a first polymer film and the permanent path comprises a second electrically conductive layer on a second polymer film.

5. The self-resetting over-current/over-temperature protection device of claim 2, wherein the separable path further comprises a layer of dielectric material on the conductive layer, the dielectric material preventing flow of electrical current from the separable path to the member, the dielectric material also conducting heat to the member, the heat being produced by the metallic layer when current flows through the separable path.

6. The self-resetting over-current/over-temperature protection device of claim 2, wherein the resistance of the permanent path is at least 2 times higher than the resistance of the separable path.

7. The self-resetting over-current/over-temperature protection device of claim 4, wherein the separable path further comprises a first layer of dielectric material on the first conductive layer, the first dielectric material being in contact with one side of the member and preventing flow of electrical current from the separable path to the member, the first dielectric material also conducting heat to the member, the heat being produced by the first conductive layer when current flows through the separable path, the permanent path further comprising a second layer of dielectric material on the second conductive layer, the second dielectric material conducting heat to an opposite side of the member and preventing flow of electrical current from the permanent path to the member.

8. The self-resetting over-current/over-temperature protection device of claim 1, further comprising a housing, the contacts being in an interior space within the housing, the contacts being movable from a first position in electrical contact with the separable path to a second position out of electrical contact with the separable path, the contacts being in the first position when the member is in the first configuration and the contacts being in the second position when the member is in the second configuration.

9. The self-resetting over-current/over-temperature protection device of claim 8, wherein the member is U-shaped with one free end of the U-shaped member facing the first contact and another free end of the U-shaped member facing the second contact, the ends of the U-shaped member being closer together in the first configuration than in the second configuration.

10. The self-resetting over-current/over-temperature protection device of claim 9, wherein the contacts comprise the means for returning the member to the first configuration, the contacts including a resilient portion mounted in the interior space so as to be spring loaded such that the contacts return to the first position when the member changes from the second configuration to the first configuration.

11. The self-resetting over-current/over-temperature protection device of claim 10, wherein the separable path comprises a first conductive layer on a first polymer film, the housing including first, second and third support surfaces in the interior space, the first support surface being arcuate and a central portion of the separable path extending around the first support surface, the second and third support surfaces being spaced apart and facing in opposite directions, one end of the separable path being attached to the second support surface and an opposite end of the separable path being attached to the third support surface.

12. The self-resetting over-current/over-temperature protection device of claim 1, further comprising a housing, the contacts being in an interior space within the housing, the contacts being immovable with respect to each other, the separable path having contact zones which are movable from a first position in electrical contact with the contacts to a second position out of electrical contact with the contacts, the contact zones being in the first position when the member is in the first configuration and the contact zones being in the second position when the member is in the second configuration.

13. The self-resetting over-current/over-temperature protection device of claim 12, wherein the member is U-shaped, the contacts being located between free ends of the U-shaped member, the ends of the U-shaped member being closer together in the first configuration than in the second configuration.

14. The self-resetting over-current/over-temperature protection device of claim 13, further comprising spring means for biasing the contact zones of the current path in the first position.

15. The self-resetting over-current/over-temperature protection device of claim 14, wherein the separable path comprises a conductive layer on a polymer film, the separable path including a dielectric layer preventing flow of electrical current from the separable path to the U-shaped member and for conducting heat to the U-shaped member, the heat being produced by the first conductive layer when current flows through the separable path.

16. The self-resetting over-current/over-temperature protection device of claim 15, wherein the spring means comprises a strip of spring material having an arcuate central portion and end sections extending from the central portion, each of the contact zones of the separable path being attached to a respective one of the end sections and the spring biasing the contact zones of the separable path towards the contacts so that the separable path is in electrical contact with the contacts when the U-shaped member is in its first configuration, the U-shaped member bending the end sections of the spring outwardly away from the contacts when the U-shaped member is in the second configuration.

17. The self-resetting over-current/over-temperature protection device of claim 12, wherein the housing includes first and second support surfaces within the interior space, the first contact being attached to the first support surface and the second contact being attached to the second support surface.

18. The self-resetting over-current/over-temperature protection device of claim 17, wherein the first and second support surfaces comprise opposite sides of a wall extending from a base of the housing and into a center of the interior space.

19. The self-resetting over-current/over-temperature protection device of claim 2, further comprising a housing, the contacts being in an interior space within the housing, the contacts being immovable with respect to each other, the separable path having contact zones which are movable from a first position in electrical contact with the contacts to a second position out of electrical contact with the contacts, the contact zones being in the first position when the member is in the first configuration and the contact zones being in the second position when the member is in the second configuration, the housing including first, second and third support surfaces within the interior space, the first contact being attached to the first support surface, the second contact being attached to the second support surface and the permanent path being attached to the third support surface.

20. The self-resetting over-current/over-temperature protection device of claim 19, wherein the first and second support surfaces comprise opposite sides of a wall extending from a base of the housing and into a center of the interior space and the third support surface extends between and connects the first and second support surfaces, the permanent path comprising a polymer film having coterminous metallic layers including a high resistance layer between two metallic layers of low resistance, the permanent path comprising the high resistance layer and the low resistance layers comprising the first and second contacts, respectively.

21. The self-resetting over-current/over-temperature protection device of claim 19, wherein the first contact comprises a copper plating on the first support surface, the second contact comprises a copper plating on the second support surface, and the permanent path comprises a metallic layer on a polymer film, the polymer film including an adhesive layer adhesively bonding the permanent path to the third support surface.

22. The self-resetting over-current/over-temperature protection device of claim 16, wherein the housing includes a cover and a base, the base including a wall extending into the interior space and the contacts extending along opposite sides of the wall, the end sections of the spring being movable towards and away from the wall, the device further including biasing means for moving the spring away from the base when the end sections of the spring move away from the wall as a result of the U-shaped member changing to its second configuration, and button means for pushing the spring towards the base for resetting the device when the member is in its martensitic state.

23. The self-resetting over-current/over-temperature protection device of claim 19, wherein the member is U-shaped and the third support surface is semi-circular in cross section and is located within a central portion of the U-shaped member.

24. The self-resetting over-current/over-temperature protection device of claim 12, wherein the housing includes a pair of leads on an exterior surface thereof, each of the leads being electrically connected to a respective one of the contacts.

25. The self-resetting over-current/over-temperature protection device of claim 1, wherein the member is in a martensitic state when the member is in the first configuration and the member is in an austenitic state when the member is in the second configuration.

26. The self-resetting over-current/over-temperature protection device of claim 4, wherein the second conductive layer comprises a nickel-chromium alloy.

27. The self-resetting over-current/over-temperature protection device of claim 3, further comprising a pair of spaced-apart copper pads on the conductive layer, each of the copper pads being in electrical contact with a respective one of the contacts when the member is in the first configuration, the copper pads being out of electrical contact with the contacts when the member is in the second configuration.

28. The self-resetting over-current/over-temperature protection device of claim 3, wherein the polymer film comprises a polyimide film.

29. An over-current/over-temperature protection device, comprising:

first and second electrical contacts;

a separable resistance electrical current path extending between the contacts, the separable path having a resistance to flow of electrical current therethrough;

breaker means for preventing flow of electrical current between the contacts through the separable path when current above a threshold value flows through the separable path and/or the over-current over-temperature protection device reaches a threshold temperature, the means comprising a member of a shape memory alloy which changes shape from a first configuration at a first temperature $T_1$ to a second configuration at a second temperature $T_2$, the second temperature $T_2$ being higher than the first temperature $T_1$, the member separating the separable path from at least one of the contacts when the member is in the second configuration; and heater means for heating the member from the first temperature $T_1$ to the second temperature $T_2$ so that the member changes from the first configuration to the second configuration, the heater means comprising the separable path.

30. The over-current/over-temperature protection device of claim 29, wherein the separable path comprises an electrically conductive layer on a polymer film.

31. The over-current/over-temperature protection device of claim 29, wherein the separable path further comprises a layer of dielectric material on the conductive layer, the dielectric material preventing flow of electrical current from the separable path to the member, the dielectric material also conducting heat to the member, the heat being produced by the conductive layer when current flows through the separable path.

32. The over-current/over-temperature protection device of claim 29, further comprising a housing, the contacts being in an interior space within the housing, the contacts being movable from a first position in electrical contact with the separable path to a second position out of electrical contact with the separable path, the contacts being in the first position when the member is in the first configuration and the contacts being in the second position when the member is in the second configuration.

33. The over-current/over-temperature protection device of claim 32, wherein the member is U-shaped with one free end of the U-shaped member facing the first contact and another free end of the U-shaped member facing the second contact, the ends of the U-shaped member being closer together in the first configuration than in the second configuration.

34. The over-current/over-temperature protection device of claim 29, further comprising a housing, the contacts being in an interior space within the housing, the contacts being immovable with respect to each other, the separable path having contact zones which are movable from a first position in electrical contact with the contacts to a second position out of electrical contact with the contacts, the contact zones being in the first position when the member is in the first configuration and the contact zones being in the second position when the member is in the second configuration.

35. The over-current/over-temperature protection device of claim 34, wherein the member is U-shaped, the contacts being located between free ends of the U-shaped member, the ends of the U-shaped member being closer together in the first configuration than in the second configuration.

36. The over-current/over-temperature protection device of claim 35, further comprising spring means for bending the U-shaped member in the first configuration when the U-shaped member is at the first temperature $T_1$, the spring means also biasing the contact zones of the separable path in the first position.

* * * * *

UNITED STATES PATENT AND TRADEMARK OFFICE

CERTIFICATE OF CORRECTION

PATENT NO. : 5,105,178

DATED : April 14, 1992

INVENTOR(S) : John F. Krumme

It is certified that error appears in the above-identified patent and that said Letters Patent is hereby corrected as shown below:

Column 2, line 44, delete "o" and insert --of-- therefor;
Column 9, line 12, delete "accurate" and insert --arcuate-- therefor;
Column 9, line 47, delete "9!" and insert --91-- therefor; and
Column 11, line 3, insert --heater means-- before "for" and delete "heater means" after "member".

Signed and Sealed this

Twentieth Day of July, 1993

*Attest:*

Michael K. Kirk

MICHAEL K. KIRK

*Attesting Officer*

*Acting Commissioner of Patents and Trademarks*